United States Patent [19]

Demarest

[11] Patent Number: 4,638,979

[45] Date of Patent: Jan. 27, 1987

[54] VEHICLE CRASH BARRIERS

[76] Inventor: Vincent M. Demarest, Ipsden, Wallingford, Oxfordshire, Great Britain, OX9 6BS

[21] Appl. No.: 717,689

[22] Filed: Mar. 29, 1985

[51] Int. Cl.[4] ..... A01K 3/00; E01F 15/00

[52] U.S. Cl. ..... 256/13.1; 256/19; 248/66

[58] Field of Search ..... 256/13.1, 19; 248/66

[56] References Cited

U.S. PATENT DOCUMENTS 2,204,556 6/1940 Ahles ..... 256/13.1
3,258,250 6/1966 McMullin ..... 256/13.1

FOREIGN PATENT DOCUMENTS 419215 2/1967 Switzerland ..... 256/13.1
435357 10/1967 Switzerland ..... 256/13.1
1134591 11/1968 United Kingdom ..... 256/13.1

*Primary Examiner*—Andrew V. Kundrat
*Attorney, Agent, or Firm*—Young & Thompson

[57] ABSTRACT

A vehicle crash barrier is designed to provide a progressively increasing resistance to impact. In one embodiment a rail (12) is mounted on upright posts (10) by means of dual connecting elements (13,14) the rear elements (13) being of rectangular box section and relatively stiff while the front elements (14) are of hexagonal cross-section and therefore more easily deformed. Some of the web pairs (16A,16B) of the hexagonal section are inclined to the direction of thrust. In another example the beam assembly includes two rails (20,21) the lower rail positioned forwards of the upper rail and mounted on dual collapsible connections (24,25) while the upper rail (20) is carried by relatively stiff connections (23).

8 Claims, 8 Drawing Figures

VEHICLE CRASH BARRIERS

This invention relates to vehicle crash barriers as used on motorways and motor roads of the type comprising a generally horizontal beam supported by upright posts.

One of the problems experienced with existing crash barriers is that if they are made sufficiently strong and rigid to withstand the impact of a heavy vehicle they are then too rigid and inflexible when struck by a light vehicle or car, and there is a risk of the light vehicle being deflected back onto the motor road out of control with the risk of creating a further accident. Accordingly it is an object of the invention to provide an improved crash barrier which will minimise this problem.

Broadly stated the invention consists in a vehicle crash barrier comprising a series of upright posts supporting a generally horizontal beam construction, the connections between the beam construction and the posts being designed to provide a progressively increasing resistance to impact by a vehicle on the beam construction. According to a preferred feature of the invention the connections between the beam construction and the posts include two elements one of which is relatively more easily deformed than the other in a horizontal direction transverse to the length of the beam construction. In a particular preferred construction the more easily deformable element includes a web which is inclined in relation to the transverse plane, and there may be two mutually inclined webs joining at an apex angle. The deformable element preferably comprises a hollow tubular open ended member of polygonal or rounded section, whereas the relatively stiff connecting element preferably includes one or more flanges lying in planes parallel to the transverse plane.

According to another preferred feature of the invention the beam construction comprises two separate rails mounted one above the other, one supported by relatively stiff connecting elements and the other by more easily deformable elements. Preferably the rail mounted on more deformable elements is set forward relative to the other rail.

Figure 1:
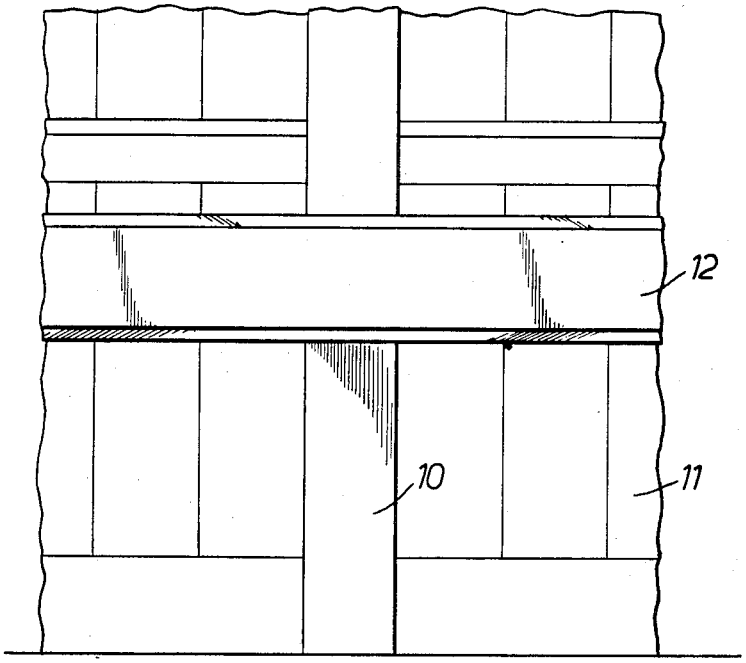
Figure 2:
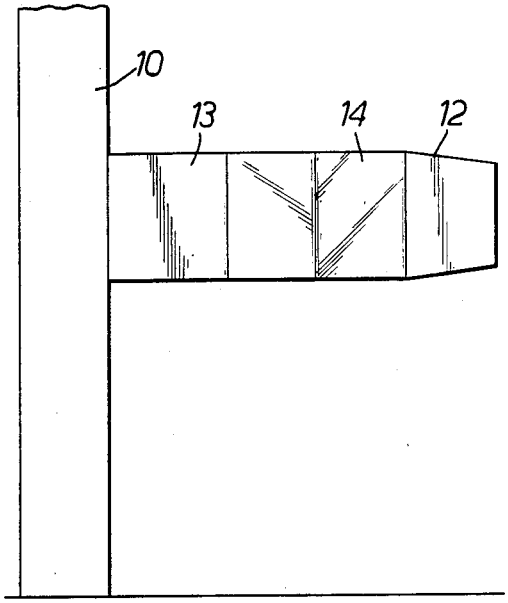
Figure 3:
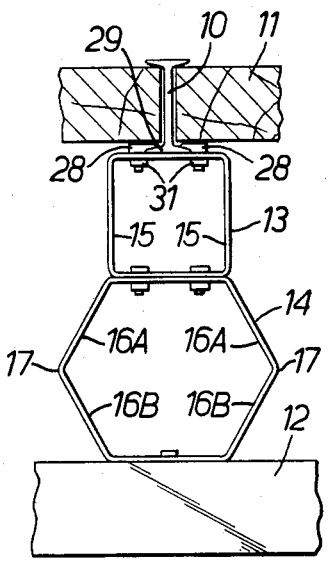
Figure 4:
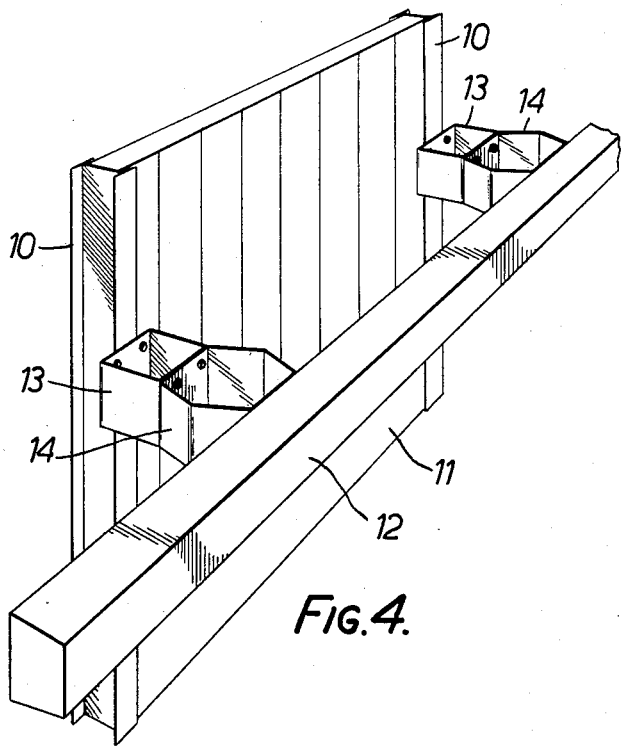
Figure 6:
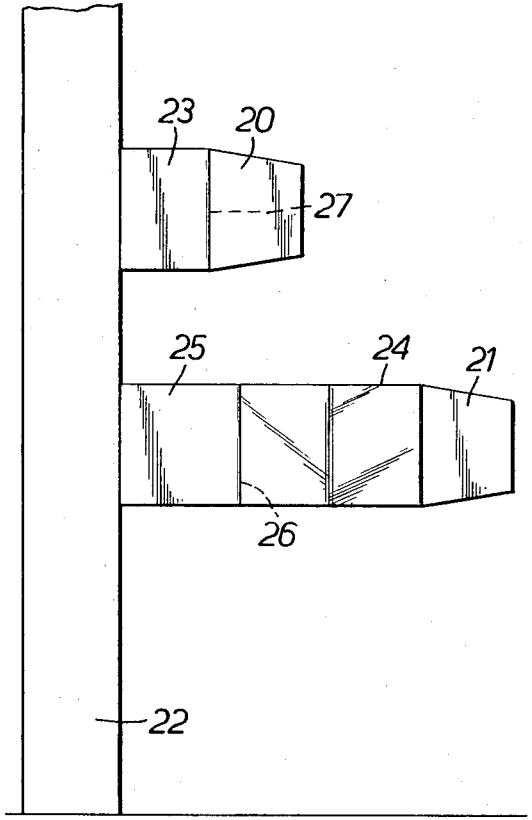
Figure 5:
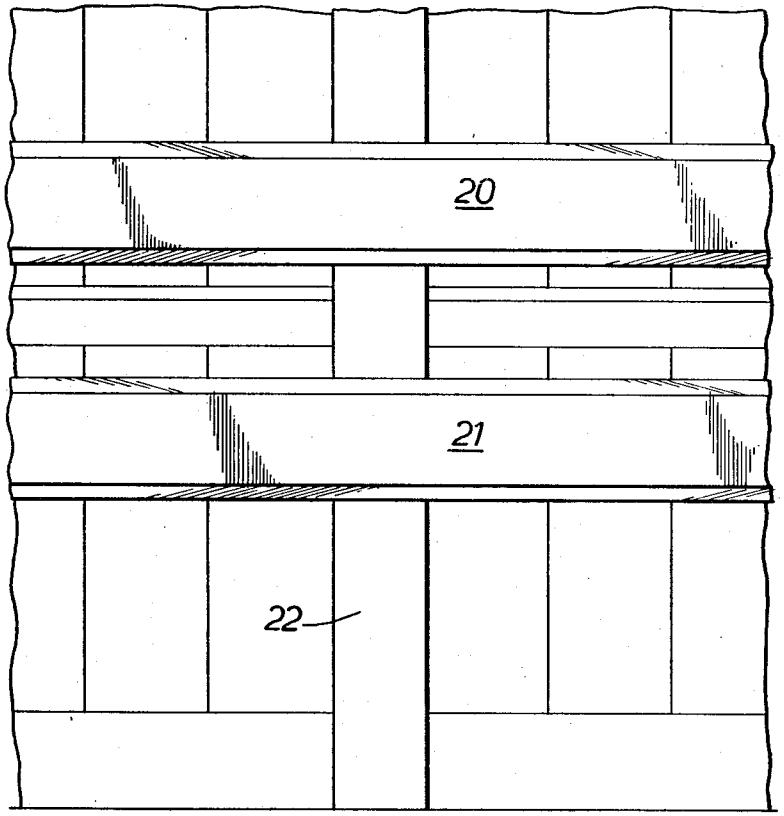
Figure 7:
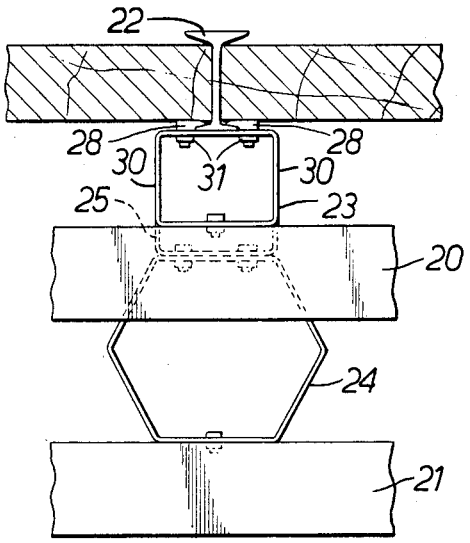
Figure 8:
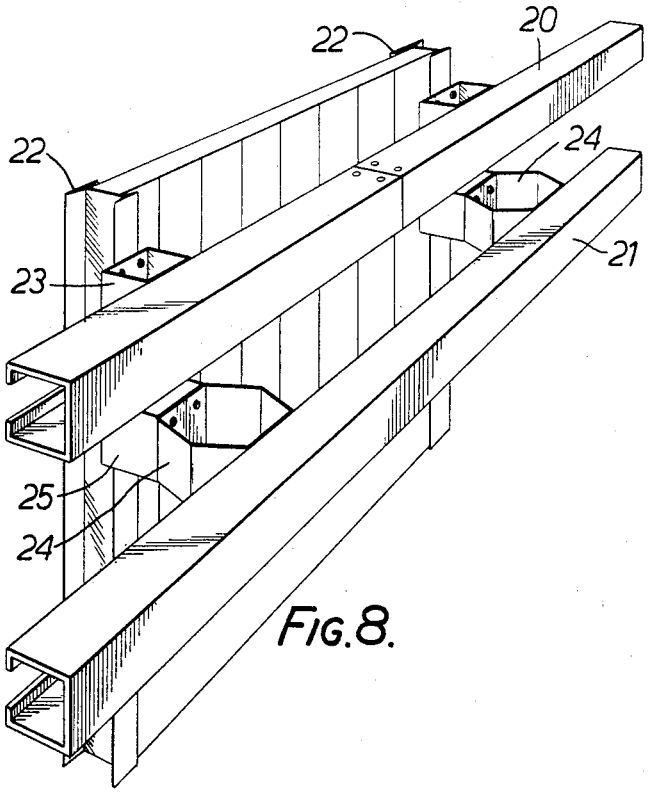

The invention may be performed in various ways and three embodiments with some possible modifications will now be described by way of example with reference to the accompanying drawings, in which:

FIG. 1 is a front elevation of a first example of crash barrier according to the invention, FIGS. 2 and 3 are end and plan views of part of the barrier, FIG. 4 is a perspective view of the barrier, FIGS. 5 and 6 are front and end elevations of a second embodiment, and FIGS. 7 and 8 are plan and perspective views of this second embodiment Referring first to FIGS. 1 to 3, a crash barrier comprises a series of upright posts 10, preferably of I-section steel set into concrete bases and in some cases interfilled by boarded timber fencing 11. The actual crash beam 12 may be of various different cross-sections, but in this particular example it is a hollow box rail of trapezoidal profile. At each upright post the rail is supported by a connection which includes front and rear connecting elements 13,14. The rear element 13 is of square box section having two webs 15 both parallel to a vertical transverse plane perpendicular to the length of the rail. This element 13 is thus relatively stiff to withstand impacts by a vehicle against the rail. The front connecting element 14 is of hexagonal box section and has two pairs of webs 16A,16B both inclined in relation to the transverse plane and meeting at apex corners 17. Thus it will be seen that this front element 14 is more radily deformed by a vehicle impact and if the crash barrier is struck by a light vehicle the force will be absorbed by collapsing of the front hexagon. This collapsing may be sufficient to absorb most of the energy of an impact from a light vehicle, but if the rail is struck by a heavy vehicle the hexagon element will be fully flattened and the heavy impact will then be absorbed by deforming and flattening of the rear square box section. Thus the system provides a progressively increasing resistance as the connection is more heavily flattened.

FIG. 3 also illustrates an important feature of the invention concerned with the attachment of the structure to the vertical eye section steel posts 10. In previous constructions the attachment was made by means of long bolts passing through the back wall of the connecting element on the front of the post, through holes drilled in the timber fencing 11 and also through heavy metal anchorage plates located behind the posts 10 on the opposite side of the timber fence. This system is awkward to assemble and erect since it requires access from both sides of the fence and it is also impossible to adjust vertically without withdrawing the bolts and drilling fresh holes, thus leaving the original holes exposed, which in the case of a noise attenuation fence would significantly reduce its effectiveness.

By contrast in the system illustrated, for example in FIG. 3, a pair of heavy duty anchor clamps 28 are secured to the rear wall of the box connecting element 13, so as to clamp the box 13 and thus the hexagon 14 securely to the adjacent flange 29 of the post 10. The fastening nuts 31 are readily accessible and the whole construction can be assembled, erected or removed from one side of the fence. Moreover it is also possible to adjust the vertical height merely by slackening the nuts 31, shifting the unit into the required position on the post 10, and retightening the nuts.

The further example illustrated in FIGS. 5 to 8 has a beam consisting of two separate rails 20,21 both mounted on common upright posts 22 with the upper rail 20 set back towards the post in relation to the lower rail 21. The upper rail 20 is supported by connecting elements 23, which are of square or rectangular box section, as clearly seen in FIG. 7, and provide more rigid support and resistance against heavy impacts. The lower rail 21 is mounted on dual connecting elements 24,25 similar to the previous example illustrated in FIGS. 2 and 3: the front element 24 is a hollow hexagon and the rear element 25 is a hollow square tubular box. It will be noted that the front wall 26 of this tubular box is positioned somewhat in front of the front wall 27 of the upper rectangular box 23.

This system provides a triple progressive increase in impact resistance. If a light vehicle strikes the lower rail 21 the first impact is absorbed by the collapse of the hexagon 24 and that may be sufficient to absorb the whole force of the impact without causing an undesirable rebound. If struck by a heavy vehicle the front hexagon will be fully flattened and the square box 25 will deform progressively thus absorbing some of the heavy force of the impact. When this square box has partially collapsed the vehicle will also strike the upper rail 20 and the overall impact resistance will then be further increased. It will be noted that the side walls 30 of the rectangular box 23, being shorter in a transverse direction than the side walls of the square box 25, will be of greater rigidity and, of course, will be acting "in parallel" with the square box providing an additive resistance. Thus it will be seen that according to one important feature of the invention the progressive increase in resistance is obtained by use of separate cushioning elements of different resistance to impact, and arranged "in series" between the beam and its supporting posts so that the force of the impact passes through both elements. Alternatively, or in addition, the two elements of different resistance may be arranged "in parallel" between the beam and the supporting posts so that the force of an impact is applied and shared between the elements. In the latter case the beam is preferably formed by two separate rails one offset forwards in relation to the other.

I claim:

1. A vehicle crash barrier comprising a series of upright posts, a generally horizontal beam construction comprising two separate rails supported on said posts one above the other, and deformable connections between said rails and said posts, the connections to one of said rails being relatively stiff while the connections to the other rail are more easily deformable, thus providing a progressively increasing resistance to impact by a vehicle on the beam construction.

2. A barrier according to claim 1, wherein the rail having the relatively stiff connections is positioned at a level above the other rail, and is set back relative thereto.

3. A barrier according to claim 1, which each of the more easily deformable connections between the beam construction and the posts includes two elements one of which is relatively more easily deformed than the other in a horizontal direction transverse to the length of the beam construction.

4. A barrier according to claim 3, in which the more easily deformable element includes a web which is inclined in relation to a transverse plane through said beam construction.

5. A barrier according to claim 1, in which each deformable connection includes two mutually inclined webs joining at an apex angle.

6. A barrier according to claim 1, in which each deformable connection element comprises a hollow tubular open ended member.

7. A barrier according to claim 1, in which each of the more easily deformable connections between the beam construction and the posts includes two elements one of which is relatively more easily deformed than the other in a horizontal direction transverse to the length of the beam construction and the relatively stiff connecting element includes at least two flanges lying in planes parallel to the transverse plane.

8. A barrier according to claim 1, in which the rail mounted on more deformable connecting elements is set forward relative to the other rail.

* * * * *